US008654112B2

(12) United States Patent
Hsu

(10) Patent No.: US 8,654,112 B2
(45) Date of Patent: Feb. 18, 2014

(54) LIQUID CRYSTAL DISPLAY DEVICE WITH DYNAMICALLY SWITCHING DRIVING METHOD TO REDUCE POWER CONSUMPTION

(75) Inventor: Chao-ching Hsu, Hsin-Chu (TW)

(73) Assignee: AU Optronics Corp., Hsin-Chu (TW)

( * ) Notice: Subject to any disclaimer, the term of this patent is extended or adjusted under 35 U.S.C. 154(b) by 1032 days.

(21) Appl. No.: 12/019,894

(22) Filed: Jan. 25, 2008

(65) Prior Publication Data

US 2009/0128540 A1 May 21, 2009

(30) Foreign Application Priority Data

Nov. 20, 2007 (TW) ..... 96143857 A

(51) Int. Cl.
*G09G 5/00* (2006.01)
*G09G 3/36* (2006.01)

(52) U.S. Cl.
USPC ..... 345/211; 345/87

(58) Field of Classification Search
USPC ..... 345/213, 214, 87, 211
See application file for complete search history.

(56) References Cited

U.S. PATENT DOCUMENTS 5,457,551 A 10/1995 Culter et al.
6,046,737 A * 4/2000 Nakamura ..... 345/213
6,426,744 B2 7/2002 Hashimoto et al.
6,850,232 B2 * 2/2005 Tazuke ..... 345/204
6,943,780 B1 9/2005 Van Dijk
6,970,163 B2 11/2005 Cairns et al.
6,982,758 B2 1/2006 Rossi
2002/0075255 A1 * 6/2002 Baek et al. ..... 345/212
2004/0217715 A1 11/2004 Yang et al.
2005/0162301 A1 * 7/2005 Mizumasa et al. ..... 341/162
2006/0038801 A1 * 2/2006 Speirs ..... 345/204
2006/0232539 A1 * 10/2006 Hashimoto ..... 345/96
2007/0018929 A1 * 1/2007 Yi ..... 345/96
2007/0091051 A1 * 4/2007 Shen ..... 345/100
2007/0195054 A1 * 8/2007 Kwon ..... 345/100
2008/0055318 A1 * 3/2008 Glen ..... 345/501
2008/0284703 A1 * 11/2008 Chao et al. ..... 345/92

FOREIGN PATENT DOCUMENTS

JP 2004151222 A 5/2004
TW 232070 5/2005
TW 200641780 12/2006

* cited by examiner

*Primary Examiner* — Chanh Nguyen
*Assistant Examiner* — John Kirkpatrick
(74) *Attorney, Agent, or Firm* — Evan R. Witt; Kirton McConkie

(57) ABSTRACT

A liquid crystal display device of reducing power consumption includes a liquid crystal panel having a plurality of liquid crystal capacitors for displaying an image, an input interface for generating a scan control signal, an oscillator for generating a predetermined frequency, a control unit electrically coupled to the oscillator for outputting a current control signal when a frequency of the scan control signal is lower than the predetermined frequency, and a driving circuit electrically coupled to the controller for generating a first bias current to charge the plurality of liquid crystal capacitors of the liquid crystal panel.

1 Claim, 10 Drawing Sheets

LIQUID CRYSTAL DISPLAY DEVICE WITH DYNAMICALLY SWITCHING DRIVING METHOD TO REDUCE POWER CONSUMPTION

BACKGROUND OF THE INVENTION

1. Field of the Invention

The present invention relates to a liquid crystal display (LCD) device, and more specifically, to an LCD device having dynamically switching driving modes to reduce power consumption.

2. Description of Prior Art

With a rapid development of monitor types, novel and colorful monitors with high resolution, e.g., liquid crystal displays (LCDs), are indispensable components used in various electronic products such as monitors for notebook computers, personal digital assistants (PDAs), digital cameras, and projectors. The demand for the novelty and colorful monitors has increased tremendously.

Referring to FIG. 1 showing a schematic diagram of a liquid crystal display device according to a prior art. Liquid crystal display device 10 contains a timing controller 14, a source driver 16, a gate driver 18, and a liquid crystal panel 20 having a plurality of pixel units 22. Upon receiving clock signal from the timing controller 14, the gate drivers 18 generate scan signal to the liquid crystal panel via scan lines. Meanwhile, the source drivers 16 delivers digital image data to the liquid crystal panel 20 via data lines in response to the clock signal from the timing controller 14. As a result, the pixel units 22 show an image based on the digital image data signal and common voltage in response to the scan signal.

With reference to FIG. 2 illustrating an equivalent circuit diagram of pixel unit and source driver as shown in FIG. 1, each pixel unit 22 may simplify as a combination of resistor R and a capacitor (referred to as a liquid crystal capacitor) C. The source driver 16 will supply a bias current to charge the capacitor C to a desired voltage level based on digital image data, so that an alignment of liquid crystal molecules within the capacitor C to display various gray levels. Actually, driving ability of the source driver, dependent on output resistance of output stage and magnitude of the bias current, should be adjusted according to manifold size liquid crystal displays or data line loadings. Nevertheless, conventionally, once the source driver assembles in the LCD device, its output bias current is constant and unchangeable.

Concerning environmental conservation, in recent years, some conventional source drivers utilize charge sharing/charge recycling techniques to save output current and reduce power consumption. But such techniques spend more time on transmission from the source driver to a data line, disadvantageous to those liquid crystal displays in need of higher resolutions and shorter charging time because of insufficient charge within the data lines or capacitors.

Conventionally, the LCD device will slow frame rate in a power-saving mode to reduce power consumption. For example, the LCD device operates in a frame rate of 60 Hz in normal mode, whereas operates in another frame rate of 30 Hz in power-saving mode. Unfortunately, in spite of lower frame rate, the bias current outputted from the source driver remains constant, so actual power consumption is not expectedly reduced as much as in proportion to frame rate. As such, keeping on the constant bias current and the driving ability in the power-saving mode is inessential, supplying an adequate bias current and/or enabling charge recycling for the source driver in low frame rate is a proper proposal to efficiently save power.

SUMMARY OF THE INVENTION

Therefore, an object of the present invention is to provide a liquid crystal display device having dynamically switching driving modes. In response to lower frame rate, the source driver according to the present inventive liquid crystal display device can adjust a bias current and/or turn on/off power-saving function such as charge recycling, to reduce power consumption. Because a time period of charging the liquid crystal capacitor delays, the source driver may have more time to charge the liquid crystal capacitors, even though the driving ability lowers. The source driver can selectively output different bias current and enable/disable power-saving function based on different frame rates, thereby reducing power consumption.

Briefly summarized, the present invention provides a liquid crystal display device of reducing power consumption. The liquid crystal display device comprises a liquid crystal panel having a plurality of liquid crystal capacitors for displaying an image, an input interface for generating a scan control signal, an oscillator for generating a predetermined frequency, a control unit electrically coupled to the oscillator for outputting a current control signal when a frequency of the scan control signal is lower than the predetermined frequency, and a driving circuit electrically coupled to the controller for generating a first bias current to charge the plurality of liquid crystal capacitors of the liquid crystal panel.

According to the present invention, a method of reducing power consumption of a liquid crystal display device is provided. The liquid crystal display device comprises a liquid crystal display panel which comprises a plurality of liquid crystal capacitors. The method comprises the steps of selecting a frame rate; generating a scan control signal based on the frame rate; and outputting a first bias current or a second bias current to charge the plurality of liquid crystal capacitors of the liquid crystal display panel, based on the scan control signal frequency.

According to the present invention, a method of reducing power consumption of a liquid crystal display device is provided. The liquid crystal display device comprises a liquid crystal display panel which comprises a plurality of liquid crystal capacitors. The method comprises the steps of: (a) generating a scan control signal; (b) providing a predetermined frequency; (c) outputting a current control signal based on a frequency of the scan control signal and the predetermined frequency; and (d) outputting a bias current to charge the plurality of liquid crystal capacitors of the liquid crystal display panel, based on the current control signal.

The present invention will be described with reference to the accompanying drawings, which show exemplary embodiments of the present invention.

DETAILED DESCRIPTION OF THE INVENTION

Figure 1:
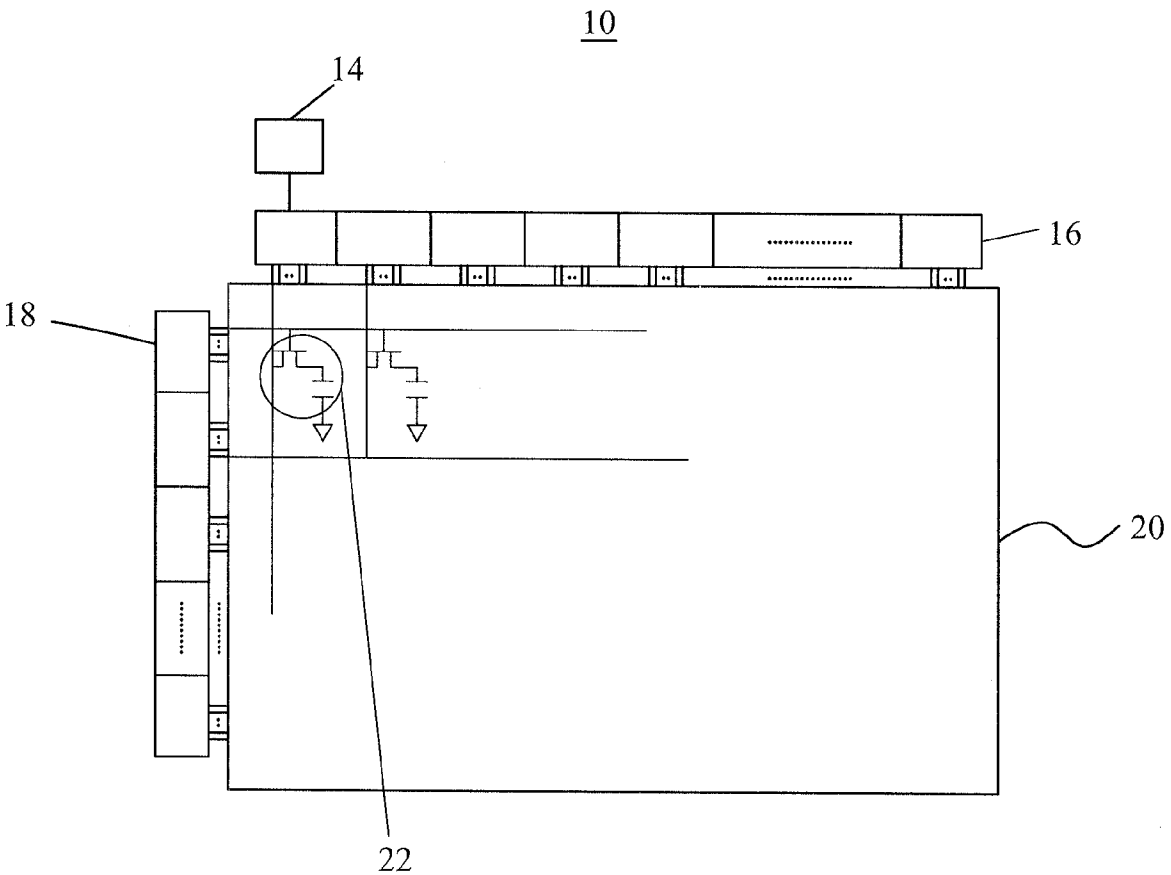
FIG. 1 (PRIOR ART)
FIG. 1 shows a schematic diagram of a conventional liquid crystal display device.
Figure 2:
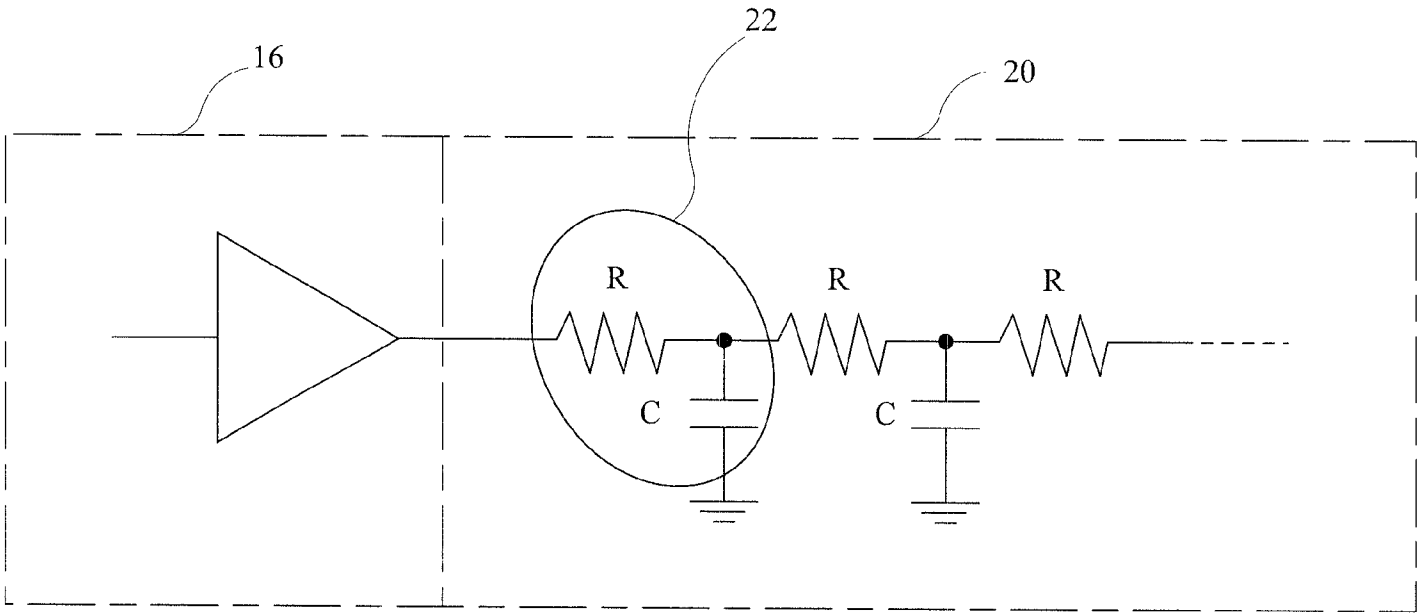
FIG. 2 (PRIOR ART)
FIG. 2 illustrates an equivalent circuit diagram of pixel unit and source driver as shown in FIG. 1.
Figure 3:
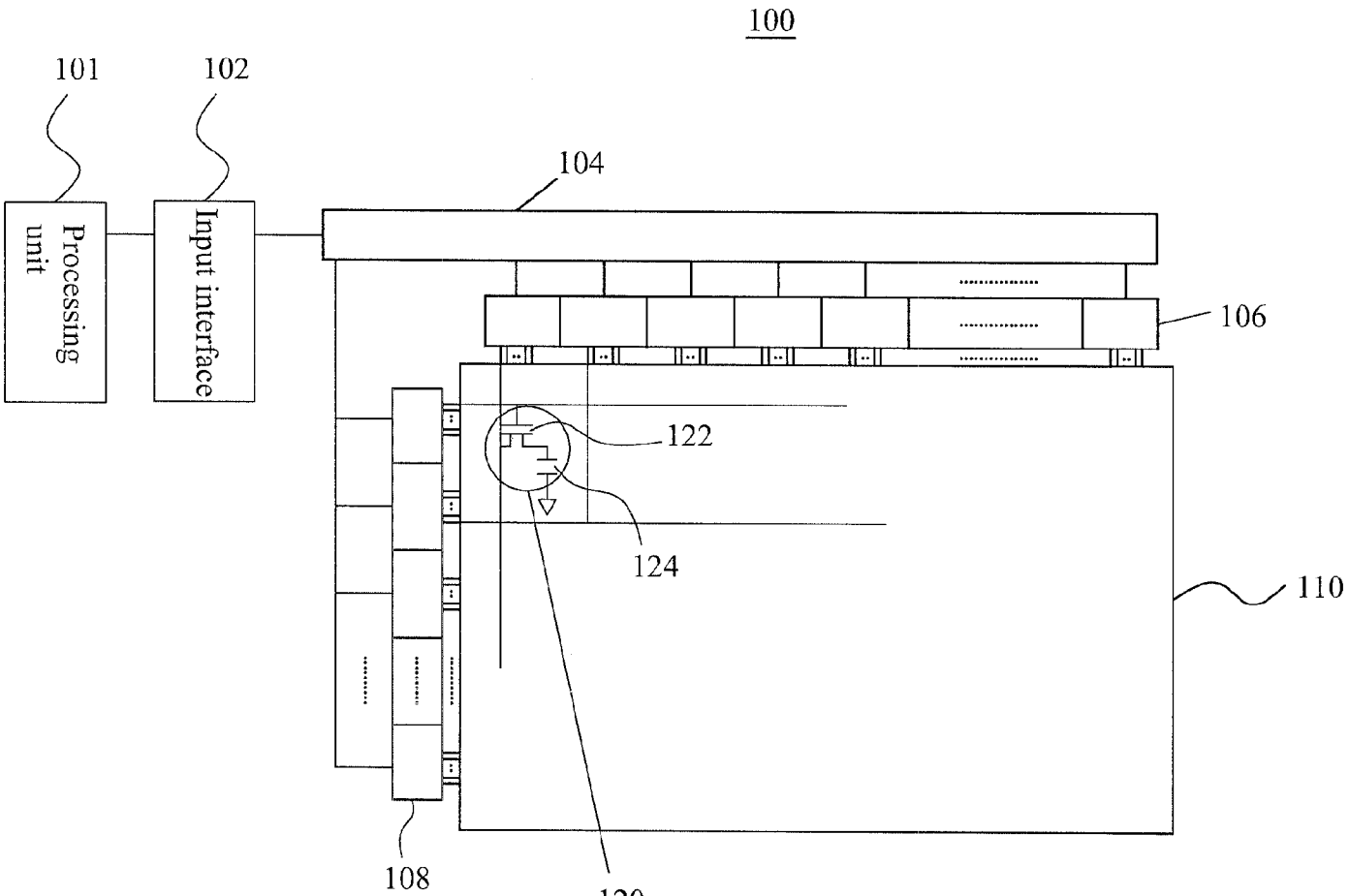
FIG. 3 shows a schematic diagram of a liquid crystal display (LCD) device according to a first embodiment of the present invention.
Figure 4:
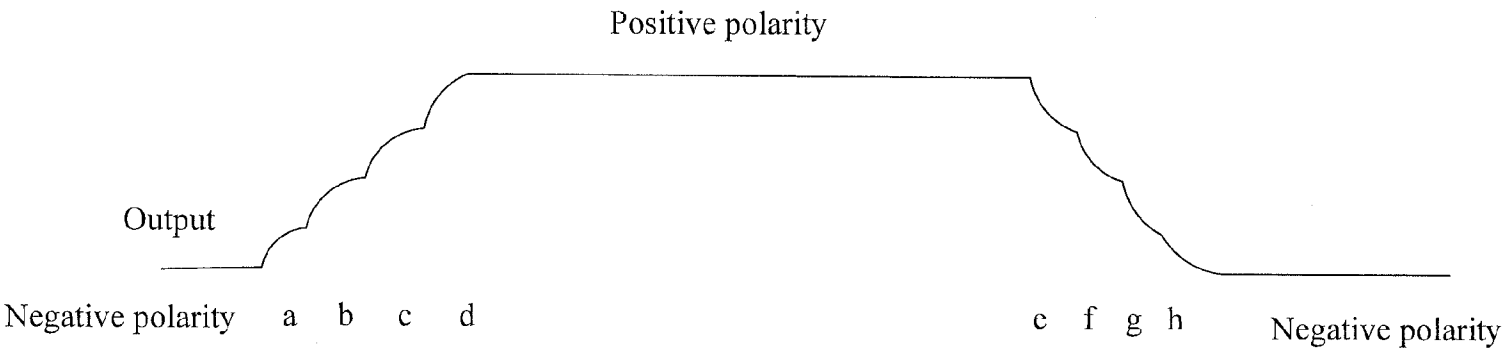
FIG. 4 illustrates pixel voltage variety during charge-recycling.

Referring to FIG. 3 showing a schematic diagram of a liquid crystal display (LCD) device according to a first embodiment of the present invention, the liquid crystal display device 100, which may be a personal computer and notebook computer, comprises a processing unit 101, an input interface 102, a timing controller 104, a source driver 106, a gate driver 108, and a liquid crystal display panel 110 having a plurality of pixel units 120, each pixel unit 120 of which comprises a transistor 122 and a liquid crystal capacitor 124. The processing unit 101 is used for controlling the operation of the LCD device 100. The source driver 106 and the gate driver 108 are disposed on a film (i.e. Chip on film, COF) or disposed on a glass substrate (i.e. Chip of glass, COG) and are electrically connected to other circuitry on a printed circuit board via a flexible printed circuit board. The timing controller 104 is coupled to the source driver 106 and the gate driver 108. Upon receiving clock signal from the timing controller 104, the gate driver 108 generates scan signals line by line to the liquid crystal panel 110. Meanwhile, the source driver 106 output a bias current to charge a liquid crystal capacitor 124 of each pixel unit 120 to comply with data signal voltage. As a result, the pixel units 120 show a grey level image based on the data signal voltage. The source driver 106 may output various bias currents or enables powering-saving function such as charge recycling. Referring to FIG. 4 illustrating pixel voltage variety during charge-recycling, a time period a-d represents variety of pixel voltage from negative polarity to positive polarity. Period a represents charging the data line through external capacitor with low voltage. Period b represents charge-sharing between the data line with negative polarity and the data line with positive polarity. Period c represents charging the data line through external capacitor with high voltage. Period d represents that the source 106 outputs positive polarity data signal voltage to the data line. Conversely, a time period e-h represents variety of pixel voltage from positive polarity to negative polarity. Period e represents charging the external high voltage capacitor through the data line. Period f represents charge-sharing between the data line with positive polarity and the data line with negative polarity. Period g represents pulling down the data line voltage. Period h represents that the source 106 outputs negative polarity data signal voltage to the data line.

In this embodiment, as long as the LCD device 100 is idle for a while and a powering saving mode is thus enabled, the processing unit 101 decreases the frame rate or increases the blanking time. At this moment, an input interface 102 generates a scan control signal to the timing controller 104, so that the timing controller 104 supplies a current control signal based on the scan control signal. The source driver 106 determines the bias current depending on the current control signal. For instance, the LCD device 100 operates in a frame rate of 60 Hz in normal mode, and outputs a bias current I. When the LCD device 100 operates in a frame rate of 30 Hz in the power-saving mode, the input interface 102 generates the scan control signal to drive the source driver 106 to output a bias current of 0.6×I, and/or to enable the power-saving function (e.g. charge-recycling) until the frame rate returns to 60 Hz. When the frame rate is back to 60 Hz, the source driver 106 restores the bias current I and disables the power-saving function. The bias current may be adjusted as a change in the frame rate. For example, the source driver 106 outputs the bias current I in response to the frame rate of 60 Hz, the bias current 0.6×I in response to the frame rate of 50 Hz, and a bias current 0.2×I in response to the frame rate of 30 Hz.

It should be understood to the ordinary skilled person in the art that the invention is not limited to the embodiment. For example, the number of selectable bias currents outputted depends on the design demand, and three or more bias currents are also allowed.

In one embodiment, the input interface 102 is a Low Voltage Differential Signaling (LVDS) controller, and the scan control signal is a low voltage differential signal.

In one embodiment, the input interface 102 is able to directly generate a control signal to the source driver 106 to control the bias current.

Figure 5A:
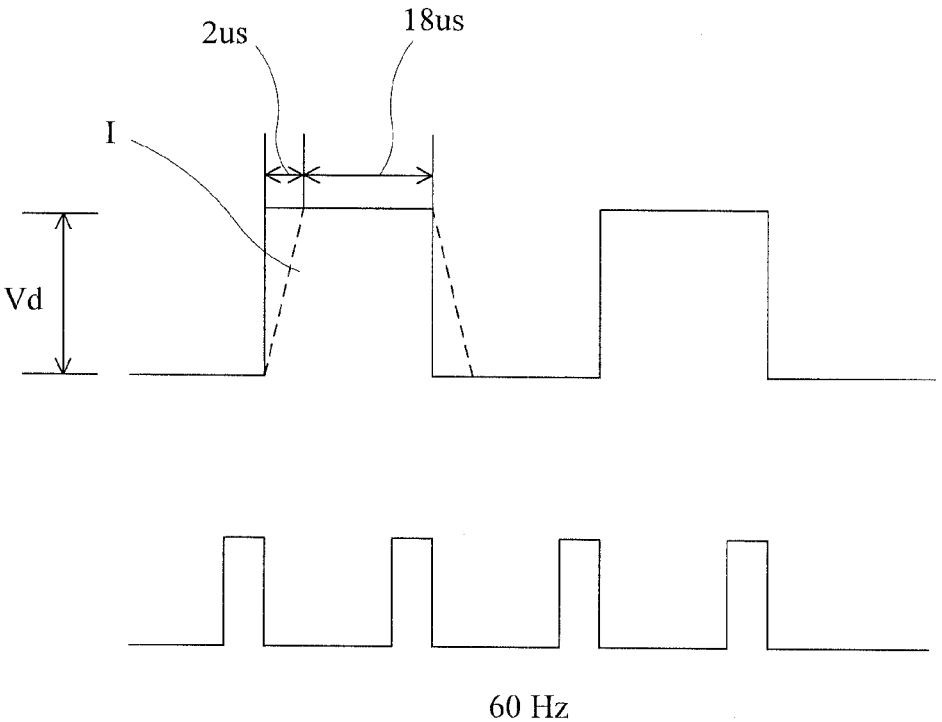
FIGS. 5A and 5B show a liquid crystal capacitor is charged by different bias currents corresponding to frame rates of 60 Hz and 30 Hz, respectively.
Figure 5B:
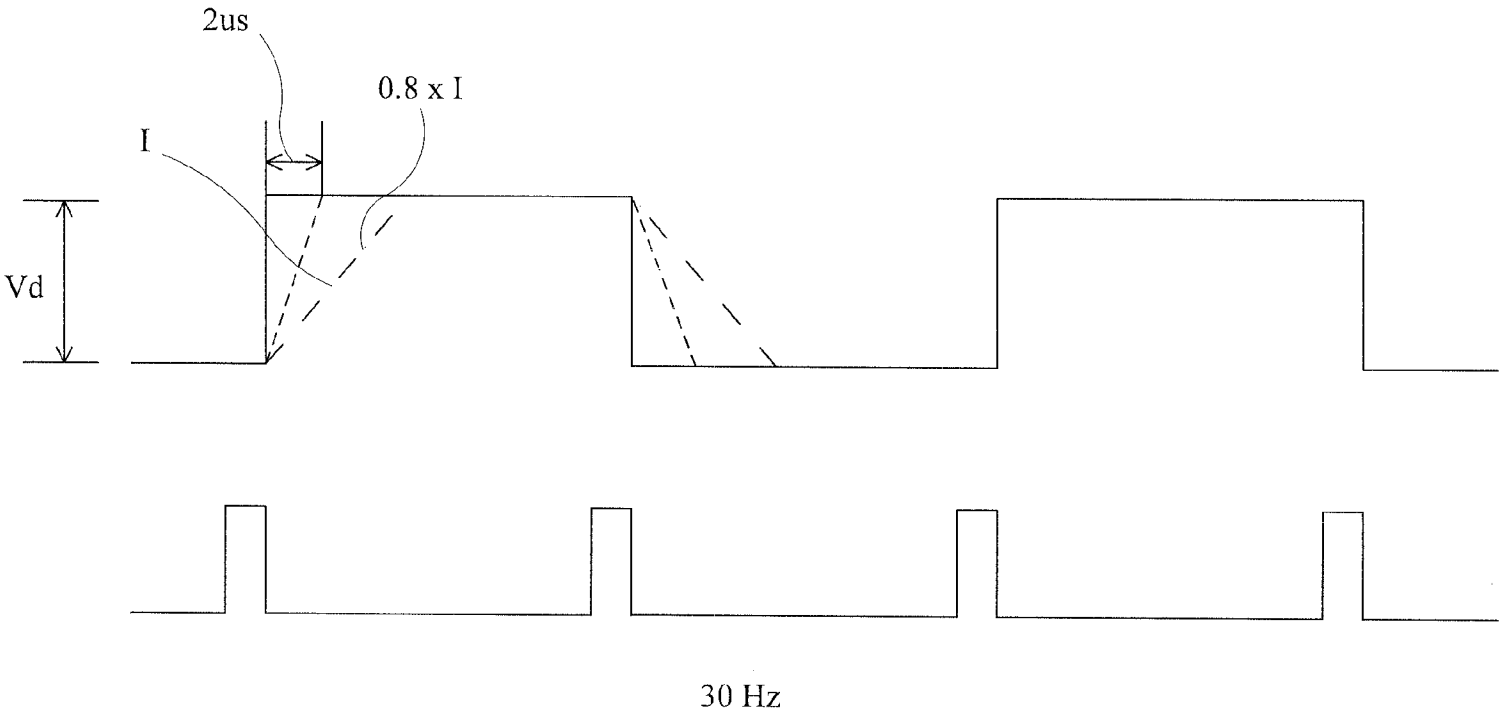
Figure 6:
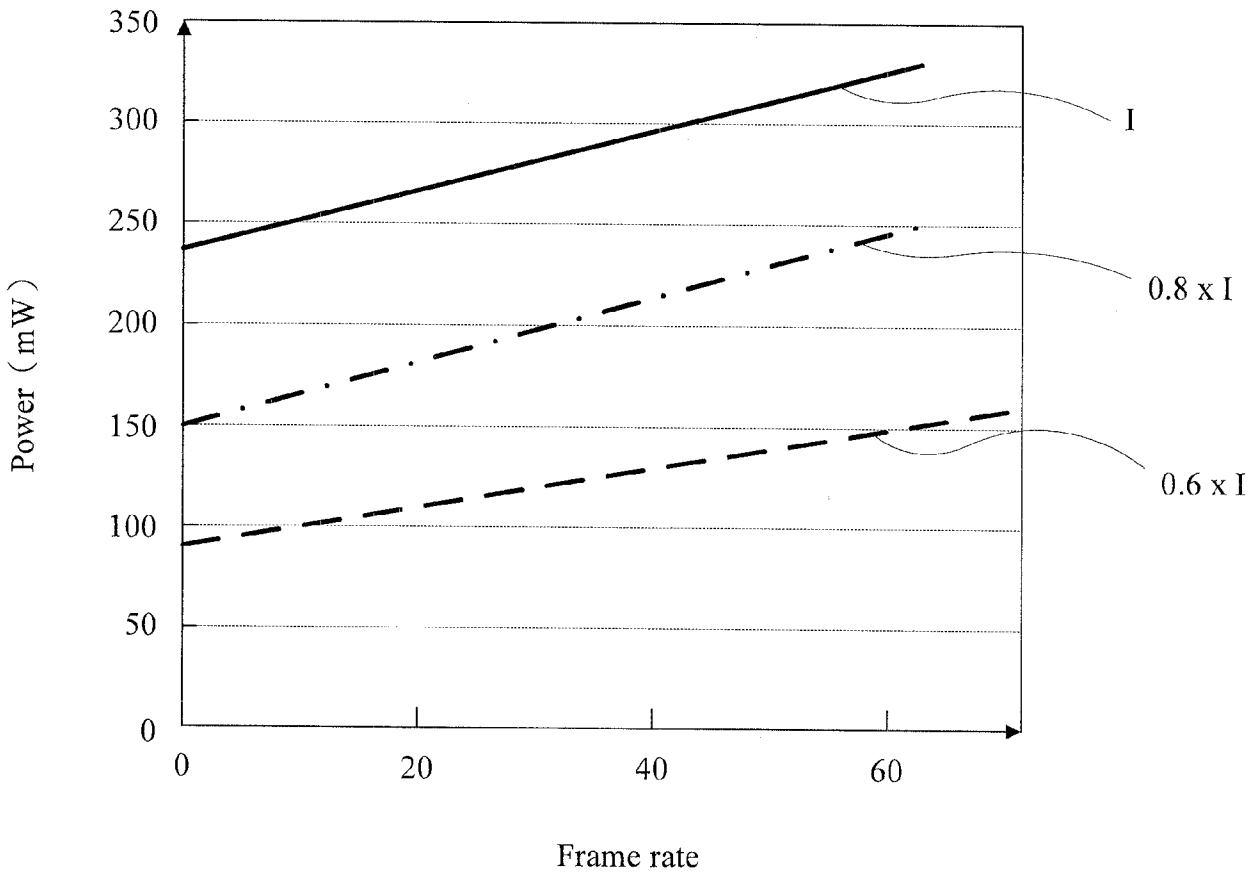
FIG. 6 illustrates a relationship of frame rate and power between a conventional LCD device and the present inventive LCD device.

Please refer to FIG. 3 in conjunction to FIGS. 5A and 5B showing a liquid crystal capacitor is charged by different bias currents corresponding to frame rates of 60 Hz and 30 Hz, respectively. As shown in FIG. 5A, in a frame rate of 60 Hz, i.e. each scan interval for a line requires 20 us, in case that the bias current I charging the liquid crystal capacitor to the data signal voltage Vd spends 2 us, the liquid crystal capacitor displays a corresponding gray level for a time period of 18 us accordingly. From a view of FIG. 5B, in a frame rate of 30 Hz, i.e. each scan interval for a line requires 40 us, even though the bias current I charging the liquid crystal capacitor to the data signal voltage Vd still spends 2 us, the liquid crystal capacitor display time period of 38 us is too long. Despite lowering the bias current lowers to 0.2×I and enabling the charge-recycling function may extends charging time as well as shortens display time, a reduction of power consumption by about 40% and few sensitivity on visual effect for human eyes are advantages for the source driver 106 to lower the bias current. With reference to FIG. 6 illustrating a relationship of frame rate and power between conventional LCD device and the present inventive LCD device, as the frame rate lowers to 30 Hz as well as lowers bias current, power consumption reduces by 40%. That is, in power-saving mode (low frame rate), the present inventive LCD device 100 can save more power than prior art LCDs.

Figure 7:
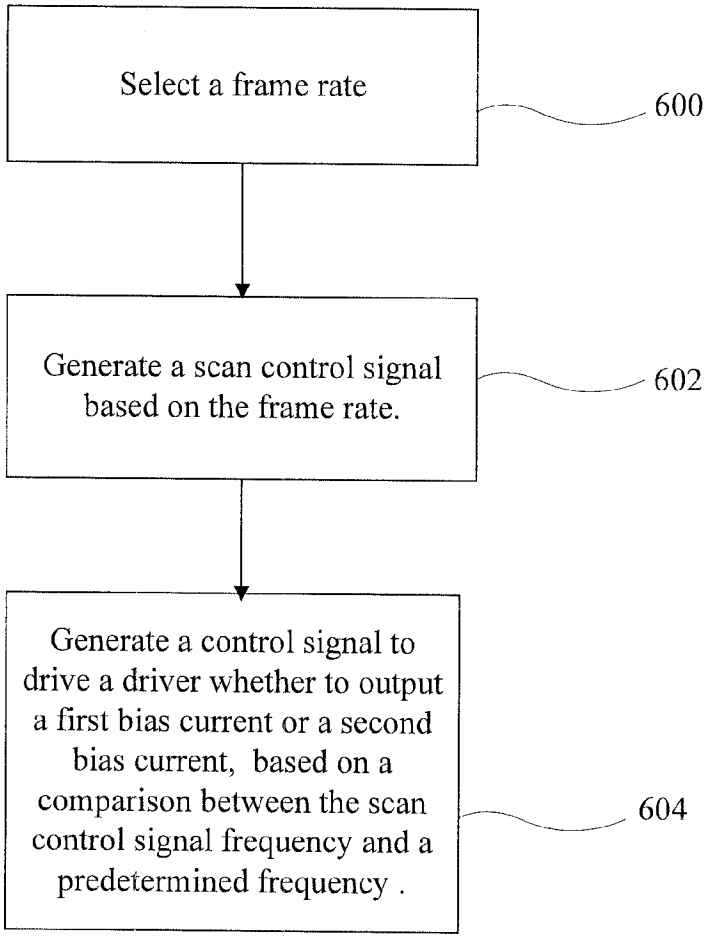
FIG. 7 shows a flowchart of a method of reducing power consumption of the LCD device according to the present invention.

Referring to FIG. 3 incorporating with FIG. 7 showing a flowchart of a method of reducing power consumption of the LCD device 100 according to the present invention, the method occurs as the following steps:

Step 600: Select a frame rate.

Step 602: Generate a scan control signal based on the frame rate.

Step 604: Generate a control signal to drive a driver whether to output a first bias current or a second bias current, and/or whether to enable or disable power-saving function, based on a comparison between the scan control signal frequency and a predetermined frequency from an oscillator.

Figure 8:
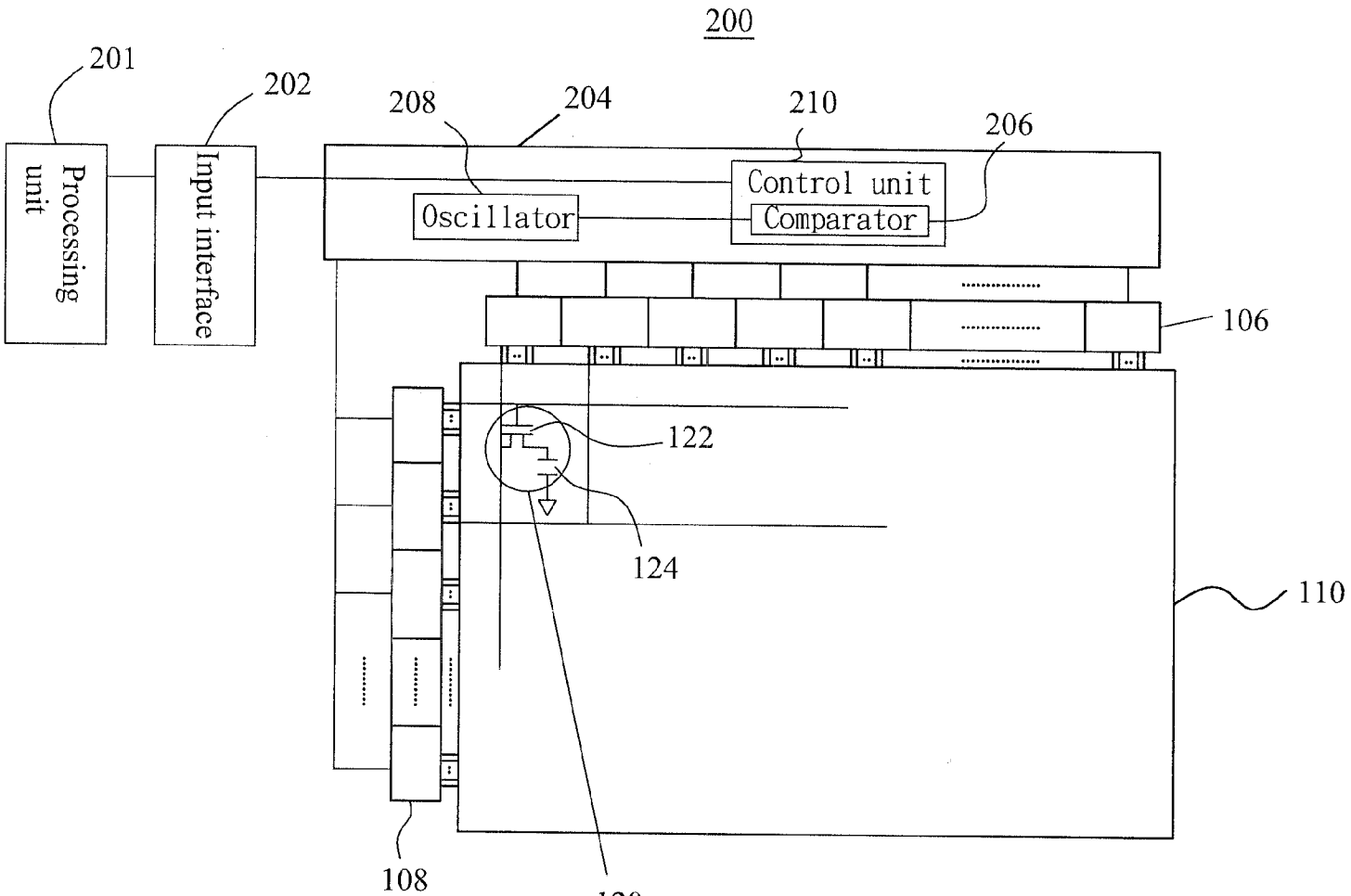
FIG. 8 shows a schematic diagram of an LCD device according to a second embodiment of the present invention.

Referring to FIG. 8 showing a schematic diagram of a liquid crystal display (LCD) device according to a second embodiment of the present invention, the liquid crystal display device 200, which may be a personal computer and notebook computer, comprises a processing unit 201, an input interface 202, a timing controller 204, a source driver 106, a gate driver 108, and a liquid crystal display panel 110 having a plurality of pixel units 120, each pixel unit 120 of which comprises a transistor 122 and a liquid crystal capacitor 124. The processing unit 201 is used for controlling the operation of the LCD device 200. The source driver 106 and the gate driver 108 are disposed on a film (i.e. Chip on film, COF) or disposed on a glass substrate (i.e. Chip of glass, COG) and are electrically connected to other circuitry on a printed circuit board via a flexible printed circuit board. It is noted that, for simplicity, elements in FIG. 8 that have the same function as that illustrated in FIG. 3 are provided with the same item numbers as those used in FIG. 3. In this embodiment, as long as the LCD device 200 is idle for a while and a powering saving mode is thus enabled, the processing unit 101 decreases the frame rate or increases the blanking time. At this moment, the input interface 202 generates a scan control signal to the timing controller 204, so that the source driver 106 determines the bias current depending on the scan control signal. In one embodiment, the input interface 202 may be a low voltage differential signaling (LVDS) controller, for generating a low voltage differential signal (i.e. the scan control signal). In another embodiment, the scan control signal may be a scan line clock signal YCLK. The timing controller 204 comprises a control unit 210 and an oscillator 208 for generating a predetermined frequency. A comparator 206 of the control unit 210 can compare a frequency of the scan control signal and the predetermined frequency from the oscillator 208. In case that the frequency of the scan control signal is greater than the predetermined frequency, as represents the LCD device 200 operates in normal mode, the source driver 106 outputs a first bias current and disables a powering-saving function such as charge-recycling. Conversely, In case that the frequency of the scan control signal is less than the predetermined frequency, as represents the LCD device 200 operates in power-saving mode, the source driver 106 outputs a second bias current which is smaller than the first bias current, and enables powering-saving function.

Figure 9:
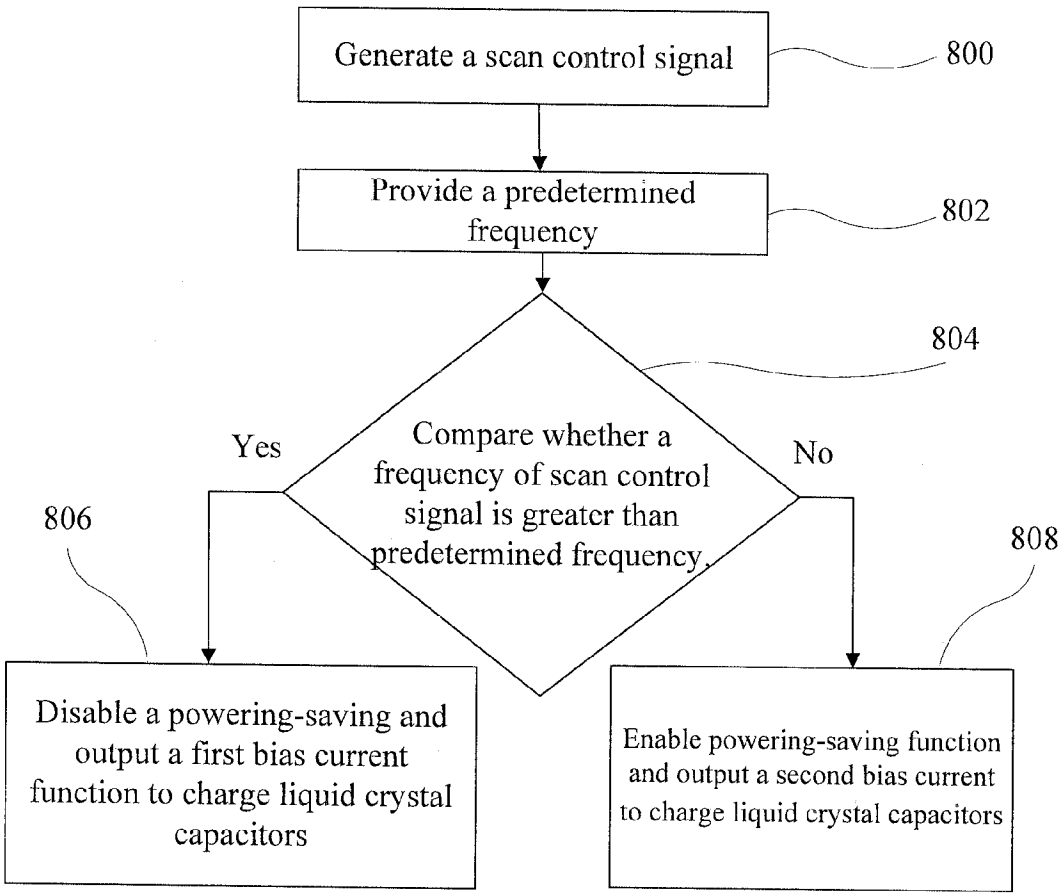
FIG. 9 shows a flowchart of a method of reducing power consumption of the LCD device according to a second embodiment of the present invention.

Referring to FIG. 9 showing a flowchart of a method of reducing power consumption of the LCD device 200 of FIG. 8 according to the present invention, the method occurs as the following steps:

Step 800: Generate a scan control signal.

Step 802: Provide a predetermined frequency.

Step 804: Compare whether a frequency of the scan control signal is greater than the predetermined frequency. If it is, go to Step 806, if not, go to Step 808.

Step 806: If the frequency of the scan control signal is greater than the predetermined frequency, the source driver 106 outputs a first bias current and disables a powering-saving function such as charge-recycling, so as to supply higher driving ability to the LCD panel 110 to charge the plurality of liquid crystal capacitors 124.

Step 808: If the frequency of the scan control signal is less than the predetermined frequency, the source driver 106 outputs a second bias current which is smaller than the first bias current, and enables the powering-saving function such as charge-recycling, so as to supply lower driving ability to the LCD panel 110 to charge the plurality of liquid crystal capacitors 124.

It should be understood to the ordinary skilled person in the art that the invention is not limited to the embodiment. For example, the number of selectable bias currents outputted depends on the design demand, and two or more bias currents are also allowed.

In another embodiment, the scan control signal may correspond to the frame rate, that is, the source driver 106 selects and outputs one bias current from two or more bias currents depending on the frame rate and the predetermined frequency.

In contrast to prior art, the present invention provides a liquid crystal display device capable of dynamically switching driving modes. The source driver can selectively output different bias current and enable/disable power-saving function based on different frame rates, thereby reducing power consumption.

While the present invention has been described in connection with what is considered the most practical and preferred embodiments, it is understood that this invention is not limited to the disclosed embodiments but is intended to cover various arrangements made without departing from the scope of the broadest interpretation of the appended claims.

What is claimed is:

1. A liquid crystal display device having dynamically switching driving modes, comprising:

a liquid crystal panel comprising a plurality of data lines and a plurality of liquid crystal capacitors, each liquid crystal capacitor being coupled to one of the data lines;

an input interface for generating a scan control signal;

an oscillator for generating a predetermined frequency;

a control unit, electrically coupled to the oscillator, for outputting a first current control signal when a frequency of the scan control signal is lower than the predetermined frequency, and for generating a second current control signal when the frequency of the scan control signal is greater than the predetermined frequency; and a driving circuit, electrically coupled to the controller, for generating a first bias current to charge the plurality of liquid crystal capacitors based on the first current control signal, for generating a second bias current which is greater than the first bias current based on the second current signal, for enabling a charge recycling function in response to the first current control signal, and for disabling a charge-recycling function in response to the second current control signal, wherein enabling the charge recycling function comprises the steps of:

(a) charging the plurality of data lines with low voltage;

(b) sharing charges between data lines with negative polarity and data lines with positive polarity after step (a);

(c) charging the plurality of data lines with high voltage;

(d) outputting positive polarity data signal voltage to the plurality of data lines;

(e) charging an external high voltage capacitor through the plurality of data lines;

(f) sharing charges between the data lines with positive polarity and the data lines with negative polarity after step (e);

(g) pulling down the data line voltage; and (h) outputting negative polarity data signal voltage to the plurality of data lines.

* * * * *